United States Patent [19]

Hao

[11] Patent Number: 5,029,846

[45] Date of Patent: Jul. 9, 1991

[54] CONTROL DEVICE FOR SIMULATING ROAD CYCLING FOR AN EXERCISING APPARATUS

[76] Inventor: Kuo-Wo Hao, No. 18, An Shun Pei Erh St., Taichung, Taiwan

[21] Appl. No.: 505,148

[22] Filed: Apr. 5, 1990

[51] Int. Cl.[5] ..... A63B 69/16; A63B 21/00; A63B 23/04

[52] U.S. Cl. ..... 272/73; 272/131; 272/132; 272/DIG. 5

[58] Field of Search ..... 272/70, 73, 93, 129, 272/130–135, DIG. 4, DIG. 5; 73/379; 128/25 R, 25 B; 446/361, 362; 74/54, 63; 188/85

[56] References Cited

U.S. PATENT DOCUMENTS 2,866,343 12/1958 Kovacs ..... 74/54
4,509,743 4/1985 Lie ..... 272/97
4,726,503 2/1988 Bowker ..... 272/73 X
4,894,936 1/1990 Van Heumen et al. ..... 446/362 X
4,934,688 6/1990 Lo ..... 272/96 X
4,934,692 6/1990 Owens ..... 272/73

*Primary Examiner*—Richard J. Apley
*Assistant Examiner*—Joe H. Cheng
*Attorney, Agent, or Firm*—Rogers, Howell & Haferkamp

[57] ABSTRACT

A control device which is provided on an upper end of an exercising apparatus includes a lever arm, and a cylinder which has a profile of hills. A belt which is provided around the wheel is controlled by a slidable engagement between the lever arm and the profile of the cylinder in order to gradually vary the frictional load on the wheel. When the belt is loosened, the frictional load on the wheel is decreased; and when the belt is tensioned, the frictional load on the wheel is increased.

4 Claims, 5 Drawing Sheets

CONTROL DEVICE FOR SIMULATING ROAD CYCLING FOR AN EXERCISING APPARATUS

BACKGROUND OF THE INVENTION

The present invention relates to a control device, and more particularly to a control device for simulating road cycling for an exercising apparatus.

Exercising apparatus are widely used nowadays. A speedometer or the like is provided on an upper portion of an exercising apparatus for indicating the speed of rotation of the flywheel of the exercising apparatus. Normally, there is no frictional load applied on flywheel of the exercising apparatus; or the frictional load is unchangeable.

An exercising apparatus having resistance means for opposing the rotation of the flywheel is disclosed in U.S. Pat. No. 3,995,491 to Wolfla, II. There are five selections of varying the frictional load on flywheel. However, once a selection is made, the frictional load on flywheel is remained constant until another selection is made, i.e., the frictional load on flywheel is unchangeable when any of the five selections is made.

SUMMARY OF THE INVENTION

The primary objective of the present invention is to provide a control device for simulating road cycling for an exercising apparatus, in which the frictional load on flywheel is varied gradually in order to simulate road cycling, such as climbing a hill or the like.

Another objective of the present invention is to provide a control device for simulating road cycling for an exercising apparatus, in which a rotatable cylinder which has a pattern or drawing of hill or the like provided therearound is provided to rotate to show a variation of the frictional load on flywheel.

In accordance with one aspect of the invention, there is provided a control device for simulating road cycling for an exercising apparatus. A flexible shaft is operatively connected to an axle of a wheel, and a belt is provided around the wheel. The control device includes a housing, and a casing being fixed in a middle portion of the housing. A lever arm is pivoted to the casing, a cable is connected between the lever arm and the belt. A gearing mechanism is disposed in the casing. A worm gear which is connected to a free end of the flexible shaft is coupled to the gearing mechanism. A cylinder which has a profile of hills is disposed on one end of the gearing mechanism. The free end of the lever arm slides along the upper surface of the cylinder. When the free end of the lever arm moves downward relative to the cylinder, the cable is loosened so that a frictional load on the wheel is decreased; and when the free end of the lever arm moves upward relative to the profile of the cylinder, the cable is tensioned so that the frictional load on the wheel is increased.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
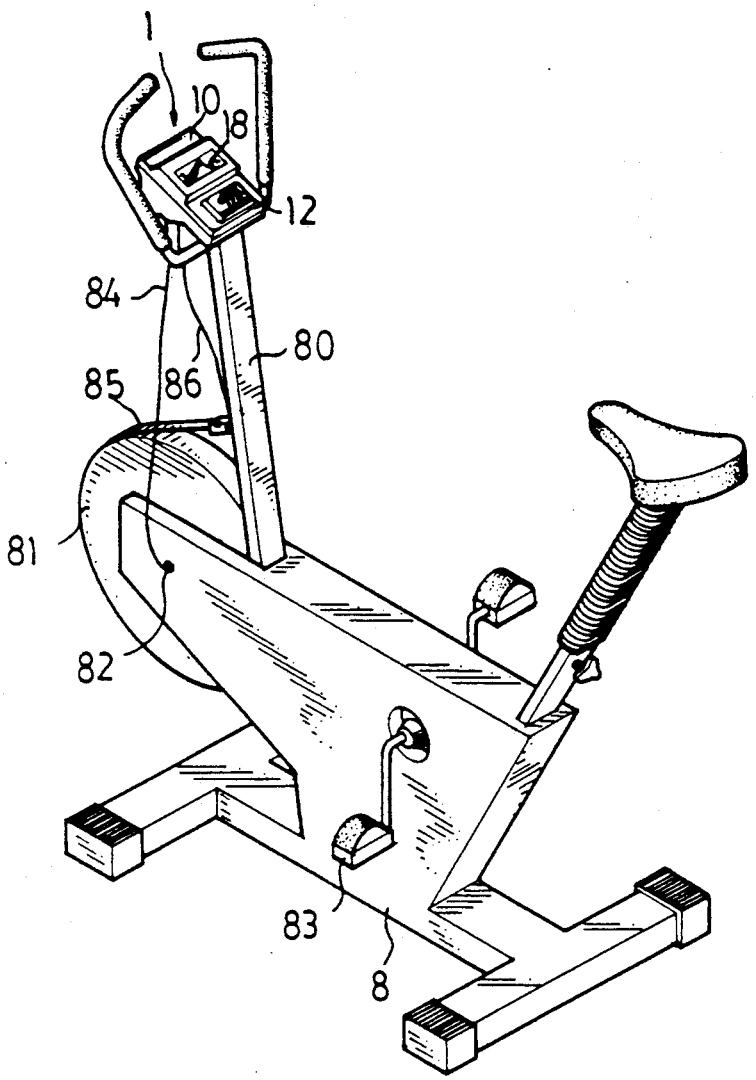
FIG. 1 is a perspective view of an exercising apparatus which employs a control device for simulating road cycling in accordance with the present invention.

Referring to the drawings and initially to FIG. 1, the control device for simulating road cycling in accordance with the present invention is generally designated by the numeral 1 and is provided on an upper end of a main post 80 of an exercising apparatus 8 which has two foot pedals 83 for driving a wheel 81.

A flexible shaft 84 which is known in the art is operatively connected to the axle 82 of the wheel 81. The flexible shaft 84 is actuated to rotate by a rotation of the wheel 81 so that the flexible shaft 84 may have a rotational output. A belt 85 which is preferably made of Nylon is provided around the wheel 81. A cable 86 is connected to the belt 85 for adjusting the tension of the belt 85 so as to vary the frictional load on the wheel 81.

Figure 2:
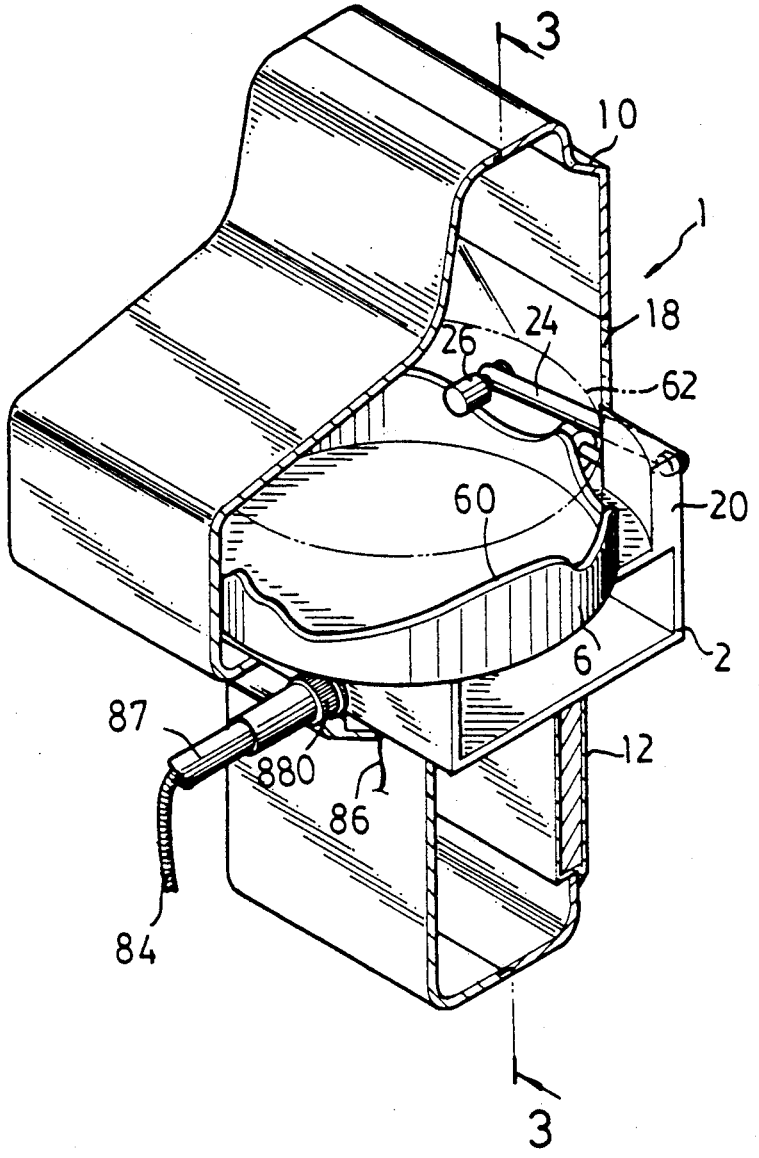
FIG. 2 is a partial perspective view of the control device for simulating road cycling.
Figure 3:
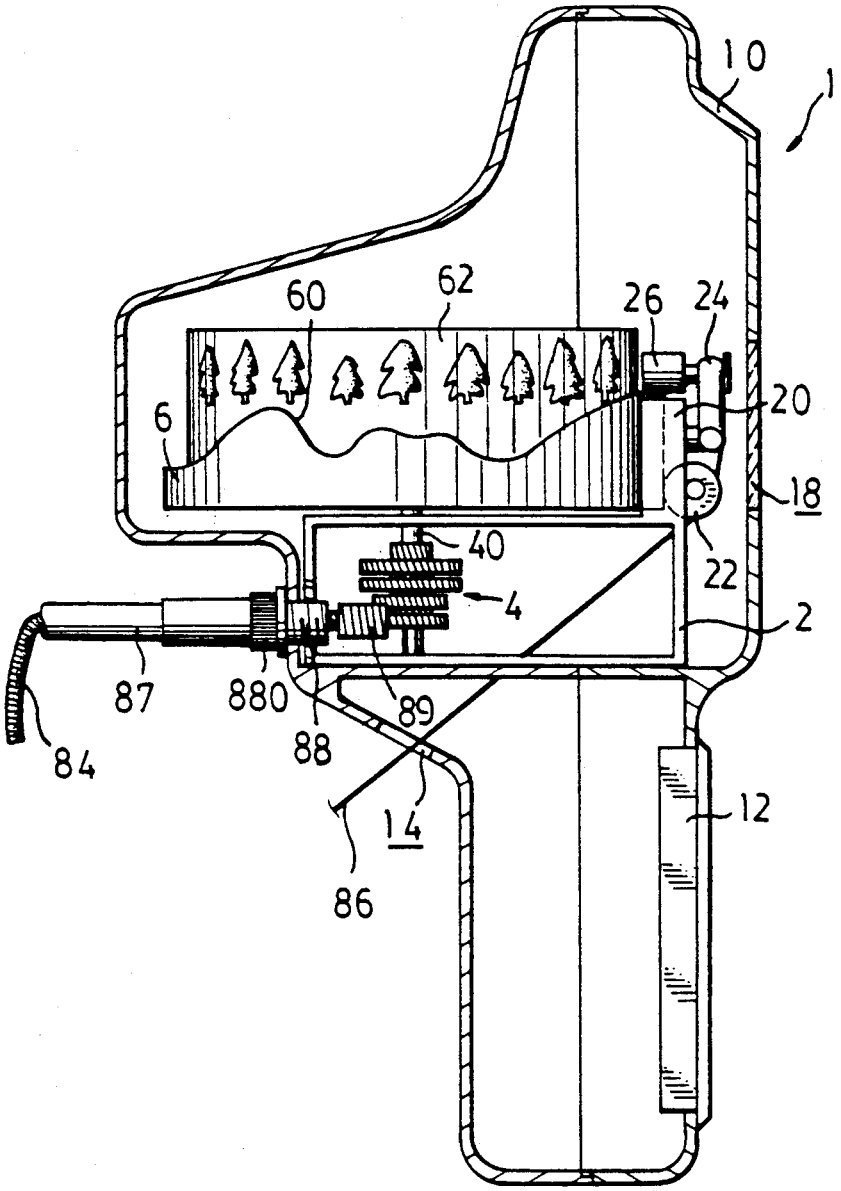
FIG. 3 is a cross sectional view of the control device taken along lines 3—3 of FIG. 2.
Figure 4:
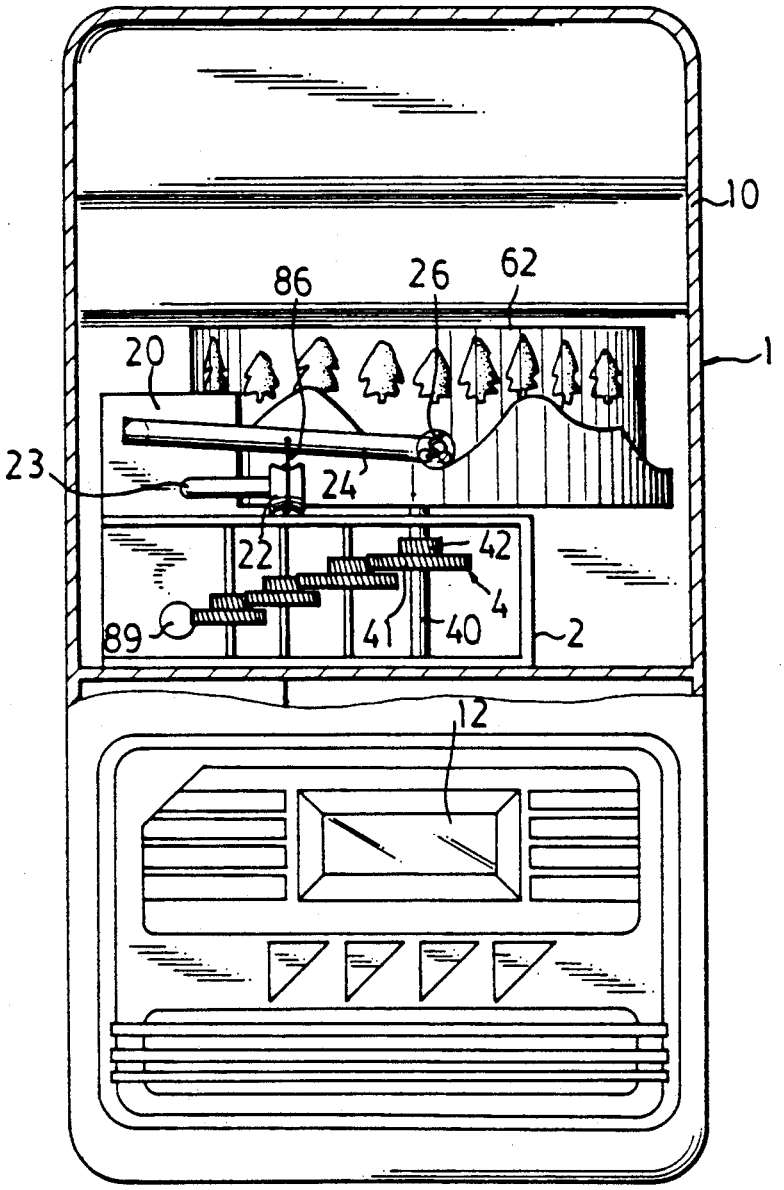
FIGS. 4 and 5 are front views of the control device, in which, for clearly illustrative purposes, part of the housing is cutoff.

Referring next to FIGS. 2, 3 and 4, the control device 1 has a housing 10 which is disposed on the upper end of the main post 80 of the exercising apparatus 8. A timer or a clock 12 is provided on a lower end of the front surface of the housing 10. A window 18 which is transparent is provided on the upper portion of the front surface of the housing 10. An opening 14 is formed in an intermediate position of the rear surface of the housing 10.

A casing 2 which is substantially a rectangular box is fixed in a middle portion of the housing 10. An end wall 20 is disposed on one end of the upper surface of the casing 2. A pulley 22 is rotatably supported on a pivot axle 23 which is fixed to the end wall 20 of the casing 2. One end of a lever arm 24 is pivotally connected to the end wall 20 so that lever arm 24 is rotatable about this end. A follower 26 is substantially perpendicularly connected to the other end of the lever arm 24. The cable 86 which has one end connected to the belt 85 passes the pulley 22 and is connected to a substantially intermediate position of the lever arm 24.

A gearing mechanism 4 is disposed in the casing 2. As is best shown in FIG. 4, the gearing mechanism 4 comprises four sets of gears coupled together, each set includes a gear 41 and a pinion 42 coaxially disposed on an axle 40 which is pivotally disposed in the casing 2. A stop 88 for holding one end of an outer sheath 87 is threadedly engaged into the middle portion of the rear surface of the housing 10 and extends into the casing 2, and is held in position by a lock nut 880 or the like. A worm gear 89 is connected to the free end of the flexible shaft 84 and is coupled to the gear 41 of the first set of the gearing mechanism 4. The gearing mechanism 4 is substantially a reduction gearing so that the rotational speed of the flexible shaft 84 which has a rotational speed corresponding to that of the wheel 81 is larger than that of the output axle 40 of the gearing mechanism 4. It is preferable that the output axle 40 of the gearing mechanism 4 is stronger or has a larger diameter than that of the other axles 40.

An outer cylinder 6 and an inner cylinder 62 are coaxially disposed on an upper end of the output axle 40 of the gearing mechanism 4 and are driven to rotate by the output axle 40. An upper peripheral surface 60 of the outer cylinder 6 has a profile of the mountains or hills, and a variety of mountain trees are drawn on the outer surface of the inner cylinder 62. The rotational speed of the cylinders 6, 62 is preferably slower than that of the flexible shaft 84 and the wheel 81. The follower 26 slidably contacts the upper peripheral surface of the outer cylinder 6. The cable 86, which has a suitable tension and which is connected to the middle of the lever arm 24, pulls the lever arm 24 downward so that the follower 26 is forced to move along the profile of the outer cylinder 6 when the outer cylinder 6 rotates.

Figure 5:
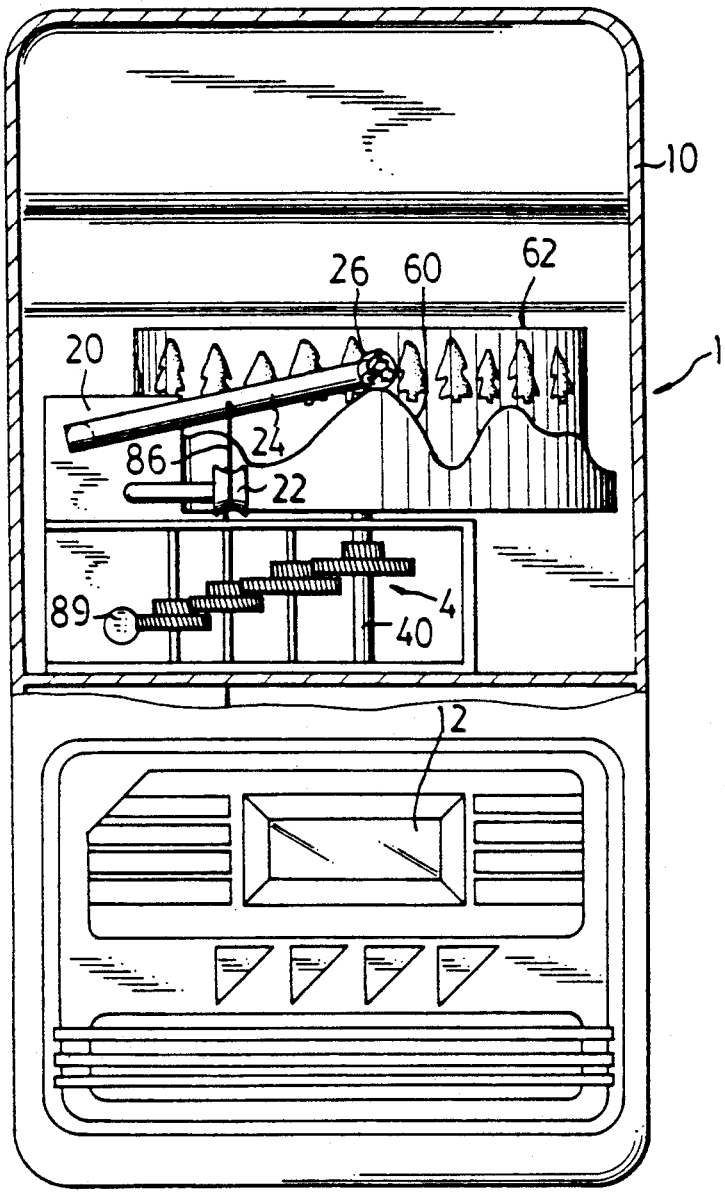

Referring again to the drawings, when the follower 26 relatively moves to a bottom, between hills, of the profile of the outer cylinder 6 as shown in FIG. 4, the cable 86 is relatively lowered so that the tension of the belt 85 is decreased and so that the frictional load on wheel 81 is decreased. When the cylinder 6 rotates until the follower 26 relatively moves to a top of the hill as shown in FIG. 5, the cable 86 is tensioned so that the frictional load on wheel 81 is increased. A relative movement between the follower 26 and the profile of the outer cylinder 6 and a relative movement between the follower 26 and the drawings of the inner cylinder 62 can be viewed through the window 18 so that the user is aware when climbing a hill or when cycling down a hill.

Accordingly, the control device in accordance with the present invention gradually varies the frictional load on wheel 81 which must be overcome by the force applied to pedals by the user. This simulates a true road cycling.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A control device for an exercising apparatus, said control device being provided on an upper end of said exercising apparatus which has two foot pedals for driving a wheel; said control device comprising a flexible shaft being operatively connected to an axle of said wheel, a belt being provided around said wheel, one end of a cable being connected to said belt in order to operate said belt, a housing being provided on said upper end of said exercising apparatus, a casing being fixed in a middle portion of said housing, one end of a lever arm being pivoted to said casing, another end of said cable being connected to a substantially intermediate position of said lever arm so that said belt is actuated by said lever arm in order to adjust a frictional load on said wheel, a gearing mechanism having an output axle and being disposed in said casing, a worm gear being connected to the other end of said flexible shaft and being coupled to said gearing mechanism, a first cylinder being disposed on one end of said output axle of said gearing mechanism and being driven to rotate by said output axle when said wheel rotates an upper peripheral surface of said first cylinder having a profile of hills, said cable which is coupled to said belt having a tension to pull said lever arm downward so that the other end of said lever arm is forced to slide along said upper peripheral surface of said first cylinder when said first cylinder rotates; when said other end of said lever arm moves downward relative to said profile of said first cylinder, said cable being loosened so that said frictional load on said wheel is decreased; and when said other end of said lever arm moves upward relative to said profile of said first cylinder, said cable being tensioned so that said frictional load on said wheel is increased.

2. A control device according to claim 1, wherein said gearing mechanism is substantially a reduction gearing comprising at least two sets of gears coupled together, each set of said gears includes a gear and a pinion coaxially disposed on an axle which is pivotally disposed in said casing, said worm gear is coupled to said gear of a first set gears, and said output axle is said axle of a last set gears.

3. A control device according to claim 1 further comprising a follower which is substantially perpendicularly connected to said other end of said lever arm and said follower slidably contacts said upper peripheral surface of said first cylinder and slides along said upper peripheral surface when said first cylinder rotates so that said other end of said lever arm can be actuated to move along said upper peripheral surface of said first cylinder.

4. A control device according to claim 1 further comprising a second cylinder which has patterns provided on an outer surface thereof is coaxially disposed in said first cylinder and rotates therewith, said other end of said lever arm moves up and down relative to said second cylinder when said other end of said lever arm slides along said upper peripheral surface of said first cylinder so that a variation of said frictional load on said wheel can be seen from a relative movement between said other end of said lever arm and said second cylinder.

* * * * *